US006303553B1

(12) United States Patent
Gorlin

(10) Patent No.: US 6,303,553 B1
(45) Date of Patent: Oct. 16, 2001

(54) POWDERED AUTOMATIC DISHWASHING CLEANING SYSTEM

(75) Inventor: Philip Gorlin, Flemington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/850,478

(22) Filed: May 7, 2001

Related U.S. Application Data

(63) Continuation-in-part of application No. 09/687,133, filed on Oct. 13, 2000, now Pat. No. 6,228,825.

(51) Int. Cl.[7] ..... C11D 1/66; C11D 3/08; C11D 3/10; C11D 3/37; C11D 17/06

(52) U.S. Cl. ..... 510/226; 510/228; 510/232; 510/233; 510/438; 510/445

(58) Field of Search ..... 510/226, 228, 510/232, 233, 445, 438

(56) References Cited

U.S. PATENT DOCUMENTS

| | | | | |
|---|---|---|---|---|
| 4,678,594 | * | 7/1987 | Parfomak et al. | 252/186.33 |
| 5,258,132 | * | 11/1993 | Kamel et al. | 252/94 |
| 5,656,584 | * | 8/1997 | Angell et al. | 510/441 |
| 6,060,444 | * | 5/2000 | Schultz et al. | 510/451 |
| 6,087,311 | * | 7/2000 | Van Dijk | 510/294 |
| 6,133,214 | * | 10/2000 | Jung et al. | 510/296 |
| 6,150,324 | * | 11/2000 | Lentsch et al. | 510/446 |
| 6,228,825 | * | 5/2001 | Gorlin et al. | 510/226 |

* cited by examiner

*Primary Examiner*—Gregory Delcotto
(74) *Attorney, Agent, or Firm*—Richard E. Nanfeld

(57) ABSTRACT

The present invention relates to a powdered automatic dishwashing composition disposed in a water soluble package that can be added directly into an automatic dishwasher.

1 Claim, No Drawings

POWDERED AUTOMATIC DISHWASHING CLEANING SYSTEM

RELATED APPLICATION

This application is a continuation in part application of U.S. Ser. No. 09/687,133 filed Oct. 13, 2000, now U.S. Pat. No. 6,228,825.

FIELD OF THE INVENTION

The present invention relates to a powdered automatic dishwashing composition disposed in a water soluble package that can be added directly into an automatic dishwasher.

BACKGROUND OF THE INVENTION

U.S. Pat. Nos. 6,191,088; 5,998,346; 5,693,602; 5,750483; 5,468,411; 5,279756; 5,240,632 and 5,205954 relate to an aqueous gel automatic dishwashing composition. The use of these compositions are burdensome and difficult to obtain precise dosing.

SUMMARY OF THE INVENTION

The present invention relates to an automatic dishwashing cleaning system comprising:

(a) a water soluble container; and (b) a powdered automatic dishwashing composition disposed in said water soluble container.

An object of the present invention is to provide a powdered automatic dishwashing composition disposed in a water soluble container, wherein the system containing the powdered automatic dishwashing composition and container can be placed directly into an automatic dishwasher.

DETAILED DESCRIPTION OF THE INVENTION

The present invention relates to an automatic dishwashing cleaning package which is a system comprising:

(a) a water soluble container; and (b) a powdered automatic dishwashing composition disposed in said water soluble container, wherein said powdered automatic dishwashing composition comprises approximately by weight:

(i) 20% to 36%, more preferably 22% to 30% of at least on alkali metal phosphate detergent builder salt;

(ii) 0.5% to 10%, more preferably 1% to 8% of a nonionic surfactant;

(iii) 4% to 16%, more preferably 6% to 12% of a silicate compound;

(iv) 10% to 35%, more preferably 15% to 30% of an alkali metal nonphosphate detergent builder salt;

(v) 0 to 10%, most preferably 0.1% to 8%, more preferably 0.5% to 8% of a mixture of a protease enzyme and an amylase enzyme in a weight ratio of protease enzyme to amylase enzyme of 10:1 to 1:10, more preferably 2:1 to 1:2;

(vi) 0 to 5%, more preferably 0.1% to 6% of a chlorine bleach; and (vii) 1% to 25% of an alkali metal sulfate such as sodium sulfate.

Excluded from the instant compositions are anionic surfactants, fatty acid or alkali metal salts of fatty acid, crosslinked polyacrylate polymers and more than 10 wt. % of water.

The nonionic surfactants that can be used in the present powdered automatic dishwasher detergent compositions are generally described as ethoxylated/propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic surfactants that are used are the low-foaming polyalkoxylated lipophiles wherein the desired hydrophile-lipophile balance is obtained from addition of hydrophilic poly-lower alkoxy group to a lipophilic moiety. A preferred class of the nonionic detergent employed is the poly-lower alkyoxylated higher alkanol wherein the alkanol is of 9 to 18 carbon atoms and wherein the number of moles of lower alkylene oxide (of 2 or 3 carbon atoms) is from 3 to 15. Of such materials, it is preferred to employ those wherein the higher alkanol is a high fatty alcohol of 9 to 11 or 12 to 15 carbon atoms and which contain from 5 to 15 or 6 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atom and which contain about 7 ethylene oxide groups per mold.

Useful nonionics are represented by the low foam Plurafac series from BASF Chemical Company which are the reaction product of a higher linear alcohol and a mixture of ethylene and a propylene oxides, containing a mixed chain of ethylene oxide and propylene oxide, terminated by a hydroxyl group. Examples include Product A (a $C_{12}$–$C_{15}$ fatty alcohol condensed with 6 moles ethylene oxide and 3 moles propylene oxide). Product B (a $C_{12}$–$C_{15}$ fatty alcohol condensed with 7 mole propylene oxide and 4 mole ethylene oxide), and Product C (a $C_{12}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_2$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Plurafac nonionic surfactants from BASF are biodegradable, low-foaming surfactant which are specially preferred for the instant automatic dishwashing compositions. Plurafac™ SLF18 which is water dispensible and has a low surface tension and low cloud and is low foaming is especially preferred for use in the instant automatic dishwashing compositions.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

The alkali metal phosphate detergent builder salts used in the instant composition include the polyphosphates, such as alkali metal pyrophosphate, alkali metal tripolyphosphate, alkali metal metaphosphate, and the like, for example, sodium or potassium tripolyphosphate (hydrated or anhydrous), tetrasodium or tetrapotassium pyrophosphate, sodium or potassium hexa-metaphosphate, trisodium or tripotassium orthophosphate and the like. Sodium tripolyphosphate is more preferred. The alkali metal nonphosphate detergent builder salts include sodium or potassium carbonate, sodium or potassium citrate, sodium or potassium nitrilotriacetate, and the like, wherein sodium carbonate is preferred.

The silicate compound which is an alkali metal silicate compound is useful as anti-corrosion agents in the composition and these compounds function to make the composition anti-corrosive to eating utensils and to automatic dishwashing machine parts. The alkali metal silicates such as sodium silicates of $Na_2O:SiO_2$ have ratios of from 1:1 to 1:2.4. Potassium silicates of the same ratios can also be used. The preferred silicates used at a concentration of 4% to 16%, more preferably 6% to 12% are selected from the group consisting dialkali metal silicates and alkali metal silicates and mixtures thereof.

The chlorine bleach which is used in the instant composition is selected from the group of sodium dichloroisocyanurate, clichloro-dimethyl hydantoin and chlorinated TSP and mixtures thereof.

The detergent formulation also contains a mixture of a protease enzyme and an amylase enzyme and, optionally, a lipase enzyme that serve to attack and remove organic residues on glasses, plates, pots, pans and eating utensils. Lipolytic enzymes can also be used in the automatic dishwashing composition. Proteolytic enzymes attack protein residues, lipolytic enzymes fat residues and amylolytic enzymes starches. Proteolytic enzymes include the protease enzymes subtilisn, bromelin, papain, trypsin and pepsin. Amylolytic enzymes include amylase enzymes. Lipolytic enzymes include the lipase enzymes. The preferred amylase enzyme is Termamyl 300L, Type DX having an activity of 300 KNU/g. It is an alpha amylase prepared by submerged fermentation of a selected strain of *Bacillius liceniformis.*

A preferred protease enzyme is Savinase 16.0L Type, Ex sold by Novo. It has an actively of 16.KNPU/g and is prepared by submerged fermentation of an alcalophilic strain of Bacillus. Another useful protease enzyme is Durazym 16.0 L Type Ex which is sold by Novo and has an activity of 16DPU/g. It is a protein-engineered variant of Savinase.

Other conventional ingredients may be included in the instant compositions in small amounts, generally less than about 3 weight percent, such as perfume, hydrotropic agents such as the sodium benzene, toluene, xylene and cumene sulphonates, preservatives, dyestuffs and pigments and the like, all of course being stable to bleach compound and high alkalinity. Especially preferred for coloring are the chlorinated phythalocyanines and polysuphides of aluminosilicate which provide, respectively, pleasing green and blue tints. TiO2 may be employed for whitening or neutralizing offshades. The instant compositions have a pH of at least about 9.5, more preferably at least about 10.5.

The water soluble container which can be in the form of a sachet, a blow molded capsule or other blow molded shapes, an injected molded ampoule or other injection molded shapes, or rotationally molded spheres or capsules are formed from a water soluble thermoplastic resin. Water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Chris Craft Film. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is Chris Craft Film. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties. Typical film properties are:

1. Tensile strength (125 mil, break, 50% RH)=4,700 to 5,700 psi
2. Tensile modulus (125 mil, 50% RH)=47,000 to 243,000 psi; preferred range is 140,000 to 150,000 psi
3. Tear resistance (mean)(ASTM-D-199gm/ml)=900–1500
4. Impact strength (mean)(ASTM-D-1709, gm)=600–1,000
5. 100% Elongation (mean)(ASTM-D-882, psi)=300–600
6. Oygen transmission (1.5 mil, 0% RH, 1 atm)=0.0350 to 0.450 cc/100 sq. in./24 h
7. Oxygen transmission (1.5 ml, 50% RH, 1 atm)=1.20 to 1.50 cc/100 sq. in./24 h
8. 100% modulus (mean)(ASTM-D-882, psi)=1000–3000
9. Solubility (sec)(MSTM-205,75° F.) disintegration=1–15; dissolution=10–30

Typical resin properties are:

1. Glass Transition Temperature (° C.)=28 to 38; preferred is 28 to 33,
2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monsol 7030 or Monosol 8630

The extruded film is slit to the appropriate width and wound on cores. Each core holds one reel of film. The reels of slit film are fed to either a vertical form, fill, seal machine (VFFS) or a horizontal form, fill, seal machine (HFFS). The Form, Fill, Seal machine (FFS) makes the appropriate sachet shape (cylinder, square, pillow, oval, etc.) from the film and seals the edges longitudinally (machine direction seal). The FFS machine also makes an end seal (transverse direction seal) and fills the appropriate volume of non-aqueous liquid above the initial transverse seal. The FFS machine then applies another end seal. The liquid is contained in the volume between the two end seals.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

The invention may be put into practice in various ways and a number of specific embodiments will be described to illustrate the invention with reference to the accompanying examples.

All amounts and proportions referred to herein are by weight of the composition unless otherwise indicated.

EXAMPLE 1

The following formulations A–E were prepared as described below:

| | A |
|---|---|
| Sodium sulfate | 15.7 |
| Sodium dichloroisocyanurate | 3.6 |
| Na tripolyphosphate | 33.5 |
| Plurafac SLF-18 | 2.0 |
| Britesil Cc24 (disilicate) | 6.65 |
| Soda carbonate | 26.2 |
| Water | 5.0 |
| Termamyl 300L,Type DX | — |

Formula A was filed at a dosage of 25 grams by the previously described method into a polyvinyl alcohol sachet having a wall thickness of about 0.5 to 5 mls, more preferably 1 to 3 mis.

The sachet containing formula A is dissolved completely in one to two minutes during the main wash cycle in GE Triton automatic dishwashing machine.

EXAMPLE 2

The unit-dose sachet samples break apart in the dishwashing machine in a less than a minute at 120° F. in the main wash cycle of a GE Triton machine after being dosed. Table 3 shows some aging data for the sachets. Aging is being conducted in both sealed bags and in unsealed boxes. The data confirms the need for a moisture barrier of some kind.

TABLE 3

Power sachet aging results (weeks)

| 4 week aging | Package | Bleach remaining (%) | Powder moisture gain/loss % | Sachet breakage time in was sec, 120 F. | Physical appearance |
|---|---|---|---|---|---|
| 77 F. | Ziplock bag | 100 | 0 | <10 sec | Acceptable |
| | Unsealed box | 99 | −0.6 | <l0 sec | Acceptable |
| 100 F. | Ziplock bag | 93 | −0.8 | <10 sec | Acceptable |
| | Unsealed box | 100 | −2.6 | <10 sec | Hard film |
| 100 F./180% RH | Ziplock bag | 85 | +0.6 | <10 sec | Acceptable |
| | Unsealed box | 15 | +7.4 | <10 sec | Thin/sticky |

What is claimed is:

1. Coated automatic dishwashing cleaning composition in the form of an ampoule, capsule or sphear comprising:

(a) a coating material which is poly(vinyl)alcohol polymer; and (b) a powdered automatic dishwashing composition contained within said coating material, wherein said powdered automatic dishwashing composition comprises approximately by weight:

(i) 20% to 36% of sodium tripolyphosphate detergent builder salt;

(ii) 0.5% to 10% of a nonionic surfactant;

(iii) 4% to 16% of an alkalimetal silicate and/or alkalimetal disilicate;

(iv) 10% to 35% of an alkali metal carbonate detergent builder salt;

(v) 1% to 25% of sodium sulfate; and (vi) 0.1% to 5% of a chlorine bleach;

(viii) from 0.5% to 8% of a mixture of a protease enzyme and an amylase enzyme in a weight ratio of protease enzyme to amylase enzyme of 2:1 to 1:2; wherein the composition does not contain anionic surfactants, fatty acid or alkali metal salts of fatty acid, crosslinked polyacrylate polymers and more than 10% by weight water.

* * * * *